US009899031B1

(12) United States Patent
Jeong et al.

(10) Patent No.: US 9,899,031 B1
(45) Date of Patent: Feb. 20, 2018

(54) METHOD AND APPARATUS FOR INSERTING TAG INTO STEREO AUDIO SIGNAL, AND METHOD AND APPARATUS FOR EXTRACTING TAG FROM STEREO AUDIO SIGNAL

(71) Applicant: Electronics and Telecommunications Research Institute, Daejeon (KR)

(72) Inventors: Young Ho Jeong, Daejeon (KR); Dae Young Jang, Daejeon (KR); Tae Jin Lee, Daejeon (KR); Jin Soo Choi, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/674,779

(22) Filed: Aug. 11, 2017

(30) Foreign Application Priority Data

Feb. 14, 2017 (KR) ..... 10-2017-0020106

(51) Int. Cl.
*G10L 19/018* (2013.01)
*G10L 25/21* (2013.01)
*G10L 19/008* (2013.01)

(52) U.S. Cl.
CPC ..... *G10L 19/018* (2013.01); *G10L 19/008* (2013.01); *G10L 25/21* (2013.01)

(58) Field of Classification Search
None
See application file for complete search history.

(56) References Cited

U.S. PATENT DOCUMENTS

2002/0059059 A1* 5/2002 Iliev ..... C02F 1/463 704/200.1
2007/0025538 A1* 2/2007 Jarske ..... H04M 3/56 379/202.01

(Continued)

FOREIGN PATENT DOCUMENTS

KR 10-0910380 B1 8/2009
KR 10-2015-0096419 A 8/2015
WO WO 2014/100466 A2 6/2014

OTHER PUBLICATIONS

Jeong, Youngho et al. "New Separated Sound Source Synthesis based on ADRess Algorithm", The Korean Society of Broad Engineers, Nov. 2015, pp. 56-59 (1 page in English and 5 pages in Korean).

*Primary Examiner* — Paul Huber
(74) *Attorney, Agent, or Firm* — NSIP Law

(57) ABSTRACT

Provided is a tag insertion method performed by an apparatus for inserting a tag into a stereo audio signal, the method including receiving an original stereo audio signal, analyzing an energy distribution of the original stereo audio signal based on an azimuth, determining valid azimuths for control information and for a plurality of pieces of tag information based on the energy distribution, wherein the control information is used to control tag information, modulating the plurality of pieces of tag information and the control information generated based on the valid azimuths, generating a left signal and a right signal based on the modulated control information and the plurality of pieces of modulated tag information, and generating a multi-tagged stereo audio signal by mixing the generated left signal and the generated right signal with the original stereo audio signal.

16 Claims, 7 Drawing Sheets

(56) References Cited

U.S. PATENT DOCUMENTS

| | | | | |
|---|---|---|---|---|
| 2012/0213375 | A1* | 8/2012 | Mahabub | H04S 5/00 381/17 |
| 2013/0272525 | A1* | 10/2013 | Yoo | H04S 7/30 381/1 |
| 2016/0165375 | A1 | 6/2016 | Seo et al. | |

* cited by examiner

FIG. 6

| Number of pieces of tag information (N) | Valid azimuth of control information |
|---|---|
| Tag type #1 | Valid azimuth of tag information #1 |
| Tag type #2 | Valid azimuth of tag information #2 |
| • • • | |
| Tag type #N | Valid azimuth of tag information #N |

METHOD AND APPARATUS FOR INSERTING TAG INTO STEREO AUDIO SIGNAL, AND METHOD AND APPARATUS FOR EXTRACTING TAG FROM STEREO AUDIO SIGNAL

CROSS-REFERENCE TO RELATED APPLICATION(S)

This application claims the priority benefit of Korean Patent Application No. 10-2017-0020106 filed on Feb. 14, 2017, in the Korean Intellectual Property Office, the disclosure of which is incorporated herein by reference for all purposes.

BACKGROUND

1. Field

One or more example embodiments relate to method and apparatus for inserting a tag into an audio signal and method and apparatus for extracting a tag from an audio signal and, more particularly, to method and apparatus for inserting a plurality of pieces of tag information and control information for controlling tag information into a valid azimuth of a stereo audio signal and method and apparatus for extracting the inserted tag information and control information.

2. Description of Related Art

In recent years, illegal distribution of contents provided through a broadcasting service has occurred. Content providers and broadcasters related to broadcasting services may be desire to prevent the illegal distribution of the contents. To this end, technology for identifying copyrights of contents may be required.

Users consuming the contents through the broadcasting services may be desire to search for the contents. To provide a content search function, automatic contents recognition (ACR) technology may be provided. The ACR technology may allow the users to experience a new viewing effect and use various additional services.

It is difficult to simultaneously provide the aforementioned content copyright identification service and content search service through the broadcasting service at the same time. There is an issue that an additional bandwidth is required to provide the copyright identification service and the content search service in addition to a basic bandwidth allocated for the broadcasting service. Also, because various media formats and contents formats are used in the broadcasting services, there is an issue that information used for the copyright identification service and the content search service are inappropriately converted or not transmitted.

Accordingly, there is a desire for technology to simultaneously provide additional services such as the copyright identification service and the content search service at a predetermined point in time without the aforementioned issues.

SUMMARY

An aspect provides method and apparatus for inserting tag information used for an additional to be applicable to a broadcasting service into a stereo audio signal and providing the stereo audio signal, thereby effectively providing an additional service to a user although a content format is different from a media format.

Another aspect also provides method and apparatus for inserting tag information into a tagging interval associated with a specific point in time, thereby providing additional services simultaneously at a predetermined point in time.

Still another aspect provides method and apparatus for inserting tag information into a valid azimuth obtained based on an energy distribution of a stereo audio signal, thereby effectively inserting and extracting the tag information.

According to an aspect, there is provided a tag insertion method performed by an apparatus for inserting a tag into a stereo audio signal, the method including receiving an original stereo audio signal, analyzing an energy distribution of the original stereo audio signal based on an azimuth, determining valid azimuths for control information and for a plurality of pieces of tag information based on the energy distribution, wherein the control information is used to control tag information, modulating the plurality of pieces of tag information and the control information generated based on the valid azimuths, generating a left signal and a right signal based on the modulated control information and the plurality of pieces of modulated tag information, and generating a multi-tagged stereo audio signal by mixing the generated left signal and the generated right signal with the original stereo audio signal.

The valid azimuths determined with respect to the plurality of pieces of tag information may be determined to be angles within an azimuth representing an amount of energy less than or equal to a preset threshold in the energy distribution.

The valid azimuth determined with respect to the control information may be determined to be an angle within a first azimuth representing an amount of energy less than or equal to a preset threshold in the energy distribution.

The generating of the left signal and the right signal may include generating the left signal and the right signal using the valid azimuths and a signal intensity ratio between the left signal and the right signal.

The modulating of the control information and the plurality of pieces of tag information may include modulating the control information and the plurality of pieces of tag information based on a differential quadrature phase shift keying (DQPSK)-orthogonal frequency division multiplexing (OFDM) scheme or a $\pi/4$ DQPSK-OFDM scheme.

The analyzing of the energy distribution may include analyzing an energy distribution of an original stereo audio signal converted from a time domain to a frequency domain, based on an azimuth.

According to another aspect, there is also provided a tag extraction method performed by an apparatus for extracting a tag from a stereo audio signal, the method including receiving a multi-tagged stereo audio signal in which an original stereo audio signal is mixed with a left signal and a right signal, separating control information and a plurality of pieces of tag information from the multi-tagged stereo audio signal using a valid azimuth included in the control information, and demodulating the control information and the plurality of pieces of tag information.

The separating of the control information and the plurality of pieces of tag information may include separating the control information and the plurality of pieces of tag information based on an azimuth discrimination and resynthesis (ADRess) algorithm based on a signal intensity ratio between the left signal and the right signal or a degenerate unmixing estimation technique (DUET) algorithm sound source separation scheme.

The demodulating may include demodulating control information used in a subsequent tagging interval.

The plurality of pieces of demodulated tag information may be used to provide additional services simultaneously at a predetermined point in time, the additional services including a content copyright identification service, a content copy control service, a content distribution tracking service, and a content event search service.

According to still another aspect, there is also provided an apparatus for inserting a tag into a stereo audio signal, the apparatus including a processor, wherein the processor is configured to receive an original stereo audio signal, analyze an energy distribution of the original stereo audio signal based on an azimuth, determine valid azimuths for control information and for a plurality of pieces of tag information based on the energy distribution, wherein the control information is used to control tag information, modulate the plurality of pieces of tag information and the control information generated based on the valid azimuths, generate a left signal and a right signal based on the modulated control information and the plurality of pieces of modulated tag information, and generate a multi-tagged stereo audio signal by mixing the generated left signal and the generated right signal with the original stereo audio signal.

The valid azimuths determined with respect to the plurality of pieces of tag information may be determined to be angles within an azimuth representing an amount of energy less than or equal to a preset threshold in the energy distribution.

The valid azimuth determined with respect to the control information may be determined to be an angle within a first azimuth representing an amount of energy less than or equal to a preset threshold in the energy distribution.

The processor may be configured to generate the left signal and the right signal using the valid azimuths and a signal intensity ratio between the left signal and the right signal.

The processor may be configured to modulate the control information and the plurality of pieces of tag information based on a DQPSK-OFDM scheme or a $\pi/4$ DQPSK-OFDM scheme.

The processor may be configured to analyze an energy distribution of an original stereo audio signal converted from a time domain to a frequency domain, based on an azimuth.

According to yet another aspect, there is also provided an apparatus for extracting a tag from a stereo audio signal, the apparatus including a processor, wherein the processor is configured to receive a multi-tagged stereo audio signal in which an original stereo audio signal is mixed with a left signal and a right signal, separate control information and a plurality of pieces of tag information from the multi-tagged stereo audio signal using a valid azimuth included in the control information, and demodulate the control information and the plurality of pieces of tag information.

The processor may be configured to separate the control information and the plurality of pieces of tag information based on an ADRess algorithm based on a signal intensity ratio between the left signal and the right signal or a DUET algorithm sound source separation scheme.

The plurality of pieces of demodulated tag information may be used to provide additional services simultaneously at a predetermined point in time, the additional services including a content copyright identification service, a content copy control service, a content distribution tracking service, and a content event search service.

According to further another aspect, there is also provided a computer program embodied on a non-transitory computer readable medium, the computer program being configured to control a processor to perform the tag insertion method.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which:

FIG. 6 is a diagram illustrating a structure of control information used for controlling tag information according to an example embodiment.

DETAILED DESCRIPTION

Figure 1:
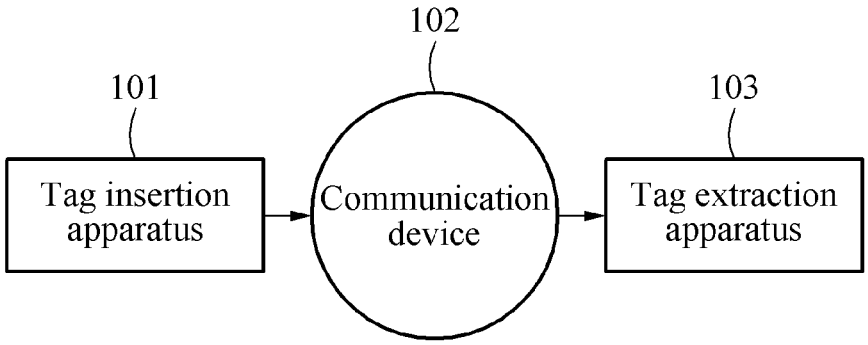
FIG. 1 is a diagram illustrating an overall process of inserting a tag into a stereo audio signal and extracting the tag from the stereo audio signal according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

FIG. 1 is a diagram illustrating an overall process of inserting a tag into a stereo audio signal and extracting the tag from the stereo audio signal according to an example embodiment.

Referring to FIG. 1, an original stereo audio signal may be input to a tag insertion apparatus 101. The tag insertion apparatus 101 may insert tag information used for an additional service such as a content copyright identification service, a content copy control service, a content event search service, and the like to be applicable to a broadcasting service, to the original stereo audio signal.

The tag insertion apparatus 101 may determine a valid azimuth to which the tag information is to be inserted from the original stereo audio signal, and then tag the tag information to the valid azimuth. In addition to the tag information, the tag insertion apparatus 101 may insert the control information to be used for extracting the tag information, to the original stereo audio signal. Likewise, the tag insertion apparatus 101 may determine the valid azimuth to which the control information is to be inserted, and then tag the control information to the valid azimuth. Through this, the tag insertion apparatus 101 may output a multi-tagged stereo audio signal obtained by inserting the tag information and the control information to the original stereo audio signal.

Transmission and reception of the multi-tagged stereo audio signal may be performed through a communication device 102. The communication device 102 may be a device configured to transmit and receive data using a communication network. The communication device 102 may be a device, for example, a broadcasting communication device or a user terminal to transmit and receive data.

A communication device may transmit the multi-tagged stereo audio signal to another communication device through a signal compression and a signal modulation. The other communication device may perform a signal demodulation and a signal restoration on the multi-tagged stereo audio signal on which the signal compression and the signal modulation have been performed. Specifically, the multi-tagged stereo audio signal may be transmitted to the other communication device while the multi-tagged stereo audio signal is in a state in which a signal is compressed and modulated by the communication device. Also, the signal demodulation and the signal restoration may be performed on the multi-tagged stereo audio signal in the other communication device.

A tag extraction apparatus 103 may receive, from the communication device, the multi-tagged stereo audio signal on which the signal demodulation and the signal restoration are performed. The tag extraction apparatus 103 may extract the original stereo audio signal, the tag information, and the control information from the multi-tagged stereo audio signal. Specifically, the tag extraction apparatus 103 may extract the control information inserted to the multi-tagged stereo audio signal and extract the tag information inserted to the multi-tagged stereo audio signal based on the control information.

When providing a broadcasting service, an additional service such as a content copyright identification service, a content copy control service, and a content event search service may be provided based on the extracted tag information. Thus, when providing the broadcasting service, the content copyright identification service, a content distribution tracking service, and the content copy control service may be used to prevent illegal distribution of contents. Also, when providing the broadcasting service, the content event search service may be used to search for an event included in contents. In this example, desired additional services may be provided simultaneously at the same time without using an additional bandwidth.

Figure 2:
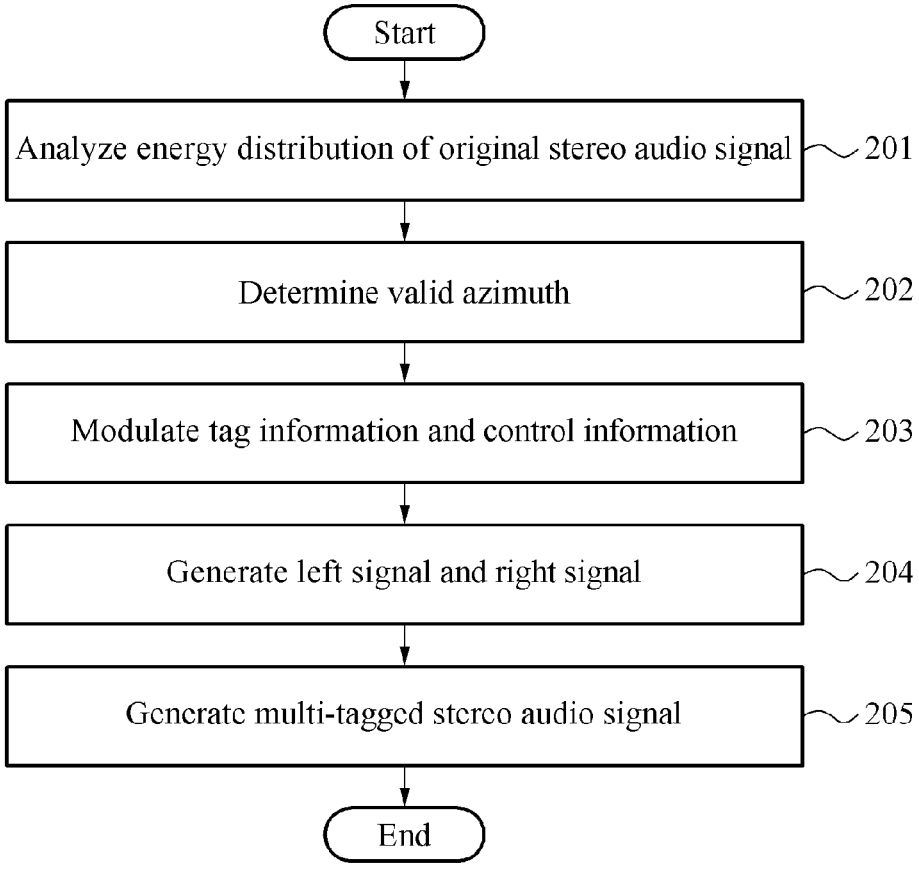
FIG. 2 is a diagram illustrating a method of inserting a tag into a stereo audio signal according to an example embodiment.

FIG. 2 is a diagram illustrating a method of inserting a tag into a stereo audio signal according to an example embodiment.

In operation 201, a tag insertion apparatus may analyze an energy distribution of an original stereo audio signal. In this instance, a processor may convert the original stereo audio signal from a time domain into a frequency domain, and then analyze the energy distribution of the original stereo audio signal in the frequency domain. The conversion from the time domain into the frequency domain may correspond to a method such as a Fourier transformation that is to be performed by those skilled in the art.

Also, the tag insertion apparatus may analyze the energy distribution of the original stereo audio signal for each of a plurality of tagging intervals in the entire time interval of the original stereo audio signal. Here, the energy distribution may be represented as an amount of energy relative to an azimuth of the original stereo audio signal.

The original stereo audio signal may be obtained by combining a left signal and a right signal having different intensities. Through this, the original stereo audio signal may represent a sound spatiality. Thus, an azimuth of the original stereo audio signal in an energy distribution may be in a range between 0 and 180 degrees (°). For example, panning may be applied as a method of representing a sound spatiality. By adjusting the intensities of the left signal and the right signal of the stereo audio signal, a sound spatial position may be determined. For example, a mono signal may be output to left and right ears at the same intensity through a headphone. In this example, a sound heard on a center may move leftward when gradually reducing the intensity of the right signal, which may be referred to as the panning.

A tagging interval may indicate a time interval in which tag information is to be inserted into the original stereo audio signal. A plurality of tagging intervals may be set in an overall time interval with respect to the original stereo audio signal.

In operation 202, the tag insertion apparatus may determine a valid azimuth for inserting tag information used for an additional service and control information used for controlling the tag information at an azimuth obtained from the energy distribution of the original stereo audio signal.

The plurality of pieces of tag information and the control information may be generated using the determined valid azimuth. In this example, the plurality of pieces of tag information and the control information may be generated based on a set format. The format may be provided in various forms.

The control information may be used to extract the tag information. Also, the control information may include, for example, the number of pieces of tag information, a tag type, a valid azimuth of the tag information, and a valid azimuth of the control information to control the tag information.

The number of pieces of tag information may indicate the number of additional services such as a content copyright identification service, a content copy control service, and a content event search service. For example, when four additional services including the content copyright identification service, the content copy control service, the content event search service, and a content distribution tracking service are provided, the number of pieces of tag information may be 4.

Also the tag type may be an identifier used for easily searching for the rag information. The additional service provided by extracting the tag information may be provided by searching for predetermined tag information using the tag type corresponding to the identifier and extracting the tag information. When playing contents, the additional services such as the content copyright identification service, the content copy control service, the content event search service, and a content distribution tracking service corresponding to the extracted tag information may be provided.

The valid azimuths of the tag information and the control information may be determined in the energy distribution associated with the azimuth of the original stereo audio signal. For example, the valid azimuth may be determined in an azimuth range representing a preset amount of energy or less. Also, the amount of energy may be set to be a value minimizing an error due to interference between inserted signals, which may occur when extracting the tag information.

In operation 203, the tag insertion apparatus may modulate the plurality of pieces of tag information and the control information.

In the present disclosure, modulation may be performed based on a scheme of, for example, differential quadrature phase shift keying (DQPSK)-orthogonal frequency division multiplexing (OFDM), and π/4 DQPSK-OFDM. Embodiments are not limited to the example and thus, various schemes may also be applicable to the modulation.

Specifically, a DQPSK may be a scheme of transmitting information using a phase difference between a previous signal and a subsequent signal, for example, ±π/4, ±3π/4. In the DQPSK, a signal determination may be performed based on a relationship between the previous signal and the subsequent signal. a π/4 DQPSK may be a scheme in which an signal point to be actually modulated may be differentially changed in phase at an interval of a symbol period and thus 8 signal points are provided. An OFDM may be a multicarrier transmission using numerous carrier waves. In the OFDM, a transmission cycle may increase for each channel by the number of carrier waves. In this example, a frequency selective channel provided in a wide-band transmission may be approximated as a frequency non-selective channel and thus, compensation may be performed using a simple single tap equalizer.

In operation 204, the tag insertion apparatus may generate a left signal and a right signal using the valid azimuth based on the modulated control information and the plurality of pieces of modulated tag information. The tag insertion apparatus may generate the left signal and the right signal using a signal intensity ration between the left signal and the right signal and the valid azimuth of the plurality of pieces of tag information and the modulated control information.

The intensities of the generated left and right signals may be set so as to minimize degradation in sound quality of the original stereo audio signal when the original stereo audio signal is mixed with the left and right signals. The additional service such as the content copyright identification service, the content copy control service, the content event search service, and the content distribution tracking service may need to be provided without adversely affecting contents.

In operation 205, the tag insertion apparatus may generate a multi-tagged stereo audio signal by mixing the generated left signal and the right signal with the original stereo audio signal.

In this example, the tag insertion apparatus may mix the left signal and the right signal with the original stereo audio signal. Also, the tag insertion apparatus may convert a mixing result from a frequency domain into a time domain, thereby generating the multi-tagged stereo audio signal into which the tag information and the control information are inserted.

Figure 3:
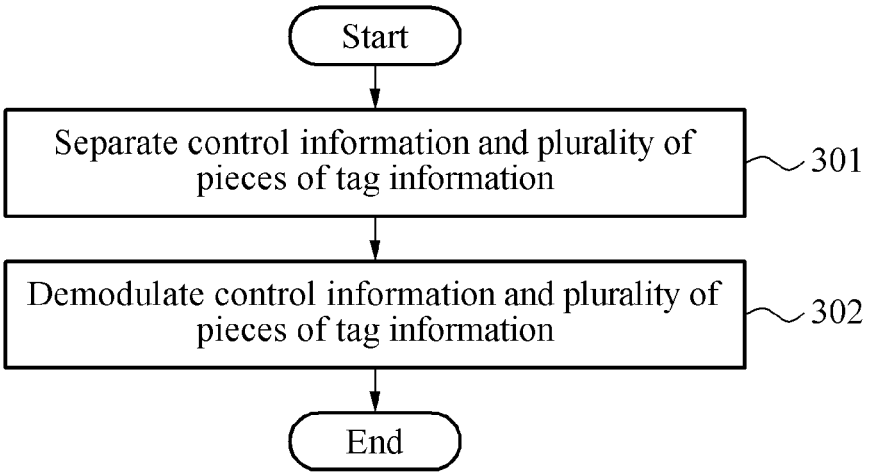
FIG. 3 is a diagram illustrating a method of extracting a tag from a stereo audio signal according to an example embodiment.

FIG. 3 is a diagram illustrating a method of extracting a tag from a stereo audio signal according to an example embodiment.

In operation 301, a tag extraction apparatus may separate control information and tag information using a valid azimuth included in control information associated with a previous tagging interval. The tag extracting apparatus may convert the multi-tagged stereo audio signal from a time domain into a frequency domain using a method, for example, a Fourier transformation.

Control information and tag information included in an acoustic area may be separated using a sound source separating scheme using a signal intensity ratio between a left signal and a right signal based on a valid azimuth included in the control information. In this example, the control information used by the tag extraction apparatus may be control information acquired in a previous tagging interval.

The tag extraction apparatus may separate a mixed sound source using an azimuth discrimination and resynthesis (ADRess) algorithm or a degenerate unmixing and estimation technique (DUET) algorithm.

The ADRess algorithm may use a human auditory characteristic for recognizing a location of a sound source based on an intensity ratio between audio signals input to left and right ears of a user. Thus, the ADRess algorithm may be suitable for separation of a stereo signal among audio signals. For example, a size component in the frequency domain may be obtained by adding up values on frequency-azimuth planes being adjacent relative to an azimuth estimated for each frame and perform a process of synthesizing the separated sound source by applying the same phase component as the input stereo signal.

The DUET may determine a two-dimensional (2D) histogram associated with symmetric attenuation and delay, and separate the sound source using a symmetric attenuation and delay value corresponding to a peck of the determined 2D histogram.

In operation 302, the tag extraction apparatus may demodulate the modulated control information and the plurality of pieces of modulated tag information obtained by separating the sound source. The tag extraction apparatus may use control information extracted in a current tagging interval when extracting the plurality of pieces of tag information in a subsequent tagging interval.

When playing contents, additional services acquired using the plurality of pieces of demodulated tag information may be provided simultaneously. The additional service may include, for example, the content copyright identification service, the content copy control service, the content event search service, and the content distribution tracking service for preventing illegal distribution of contents. In this example, the aforementioned additional services may be provided simultaneously at a predetermined point in time.

Figure 4:
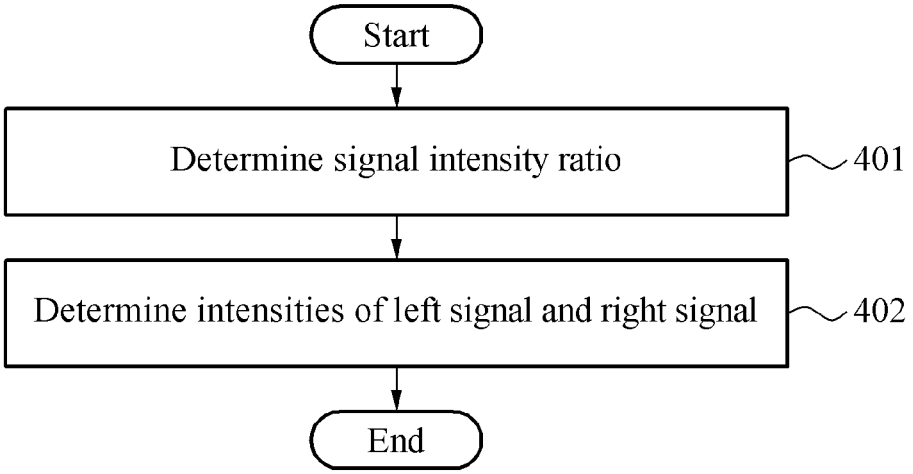
FIG. 4 is a diagram illustrating a method of generating a left signal and a right signal based on a plurality of pieces of modulated tag information and modulated control information according to an example embodiment.

FIG. 4 is a diagram illustrating a method of generating a left signal and a right signal based on a plurality of pieces of modulated tag information and modulated control information according to an example embodiment.

In operation 401, the generating method may determine a signal intensity ratio, for example, an inter-aural intensity difference (IID) between a left signal and a right signal based on a valid azimuth. A signal intensity ration, for example, the IID between the left signal and the right signal may indicate a difference in size when the stereo audio signal arrives at both ears. The signal intensity ratio may be determined based on the determined valid azimuth using Equation 1 below.

$$g(i) = \begin{cases} \tan\left(\frac{\theta_i * \pi}{360^\circ}\right), \text{ if } \theta_i \le 90^\circ \\ \tan\left(\frac{(180^\circ - \theta_i) * \pi}{360^\circ}\right), \text{ if } \theta_i > 90^\circ \end{cases} \quad \text{[Equation 1]}$$

In Equation 1, the signal intensity ratio may be distinguished based on a case in which $\theta_i$=90°, which may indicate a middle of both ears. For example, when $\theta_i$ is 90°, the stereo audio signal may not be biased to the left or right such that a user may hear the stereo audio signal from the middle of both ears.

In operation 402, the generating method may determine intensities of the left signal and the right signal based on the valid azimuth and the signal intensity ratio. In this example, the intensities of the left signal and the right signal may be set such that degradation in sound quality of the original stereo audio signal is minimized.

$$\begin{cases} x_{iR}(t) = g(i) * x_{iL}(t), \text{ if } \theta_i < 90°, \text{ (where } x_{iL}(t) = x_i(t)) \\ x_{iR}(t) = x_{iL}(t), \text{ if } \theta_i = 90°, \text{ (where } x_{iR}(t) = 0.5x_i(t)) \\ x_{iL}(t) = g(i) * x_{iR}(t), \text{ if } \theta_i > 90°, \text{ (where } x_{iR}(t) = x_i(t)) \end{cases} \quad \text{[Equation 2]}$$

In Equation 2, the intensities of the left signal and the right signal may be generated based on the valid azimuth. When the valid azimuth is less than 90°, the intensity of the right signal may be less than the intensity of the left signal based on the signal intensity ratio between the left signal and the right signal. Also, the valid azimuth is greater than 90°, the intensity of the left signal may be less than the intensity of the right signal based on the signal intensity ratio between the left signal and the right signal.

Figure 5:
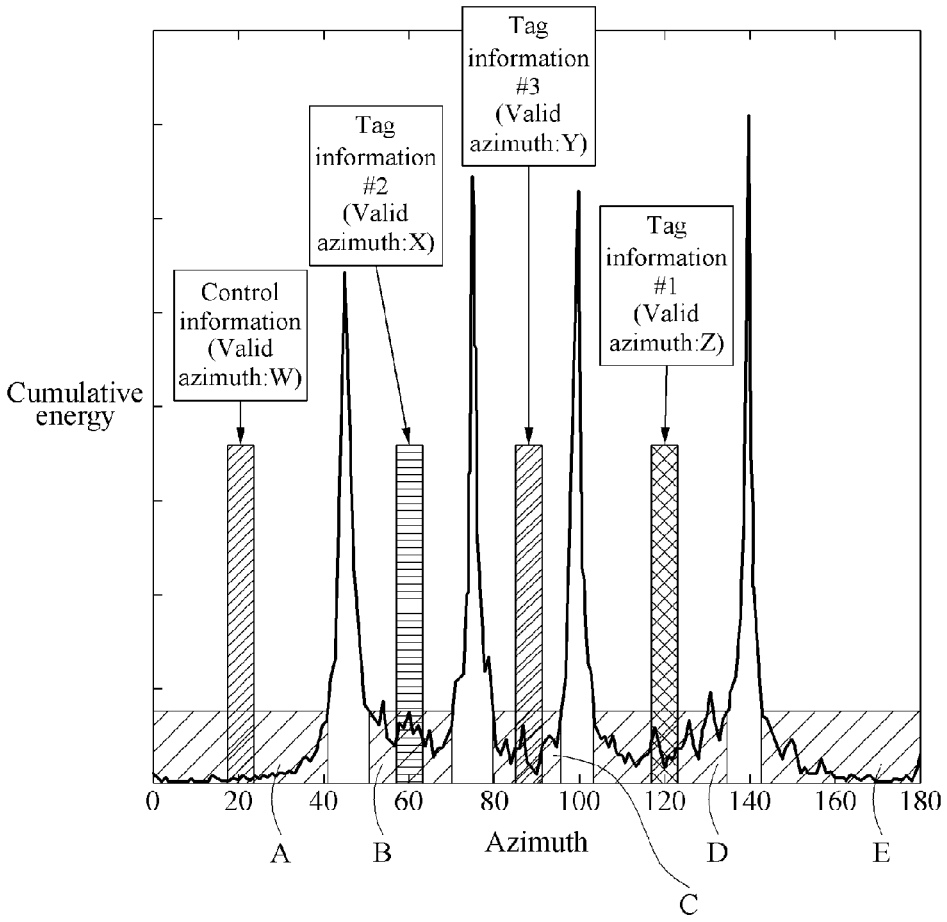
FIG. 5 is a diagram illustrating a process of determining a valid azimuth used for mapping tag information and control information according to an example embodiment.

FIG. 5 is a diagram illustrating a process of determining a valid azimuth used for mapping tag information and control information according to an example embodiment.

A valid azimuth may be determined in a range corresponding to a cumulative energy value less than or equal to a threshold. In this example, a value less than or equal to the threshold may be a value minimizing an error due to an inter-signal interference which may occur when extracting inserted control information and a plurality of pieces of tag information.

The tag insertion apparatus 101 may determine a valid azimuth of tag information in intervals of azimuths B, C, and D corresponding to the threshold or less. Since the cumulative energy value in the intervals of azimuths B, C, and D is less than or equal to the threshold, the error due to the inter-signal interference may be minimized in a process of extracting the plurality of pieces of inserted tag information. To minimize the error due to the inter-signal interference, the valid azimuth may be determined as an intermediate point of an azimuth interval in a range of the intervals of azimuths B, C, and D.

For example, the tag insertion apparatus 101 may determine a valid azimuth of the control information in an interval of an azimuth A less than or equal to a threshold. Since the cumulative energy value in the interval of the azimuth A is less than or equal to the threshold, the error due to the inter-signal interference may be minimized in a process of extracting the plurality of pieces of inserted tag information. To minimize the error, the valid azimuth may be determined as an intermediate point in the interval of azimuth A.

The tag insertion apparatus 101 may determine the valid azimuth to map the control information and the plurality of pieces of tag information in the determined azimuth range. For example, the tag insertion apparatus 101 may determine a valid azimuth W to map a value determined in the interval of the azimuth A to the control information based on the valid azimuth of the control information. For example, a processor may determine valid azimuths X, Y, and Z to map values determined in the intervals of the azimuths B, C, and D to the plurality of pieces of tag information based on the valid azimuth of the plurality of pieces of tag information.

Valid azimuths of control information for controlling tag information and a plurality of pieces of tag information associated with an additional service of a broadcasting service may be determined as the valid azimuths X, Y, Z, and W.

FIG. 6 is a diagram illustrating a structure of control information used for controlling tag information according to an example embodiment.

Structure of control information may include a number of pieces of tag information N, tag types #1 through #N, a valid azimuth of the control information, and valid azimuths #1~#N of the plurality of pieces of tag information The number of pieces of tag information may indicate the number of additional services such as a content copyright identification service, a content copy control service, a content event search service, and a content distribution tracking service for preventing illegal reproduction of contents provided in a broadcasting service field. The number of pieces of tag information may be the same as the number of additional services to be provided. For example, when N additional services are provided, N pieces of tag information may be provided. Thus, a single piece of control information may include N pieces of tag information.

The tag type may correspond to an identifier of the plurality of pieces of tag information. A processor of the tag extraction apparatus 103 easily search for tag information corresponding to an additional service to be provided using the tag type. The tag extraction apparatus 103 may search for a tag type corresponding to information to be retrieved. The tag extraction apparatus 103 may use the tag type corresponding to the identifier to easily retrieve the tag information, thereby providing the additional service. Also, a number of tag types may be the same as the number of pieces of tag information. Thus, when N pieces of tag information are provided, the number of tag types may be N.

The valid azimuths of the control information and the tag information may be determined in an azimuth interval corresponding to a relatively small energy distribution in an acoustic space. The foregoing example may be based on a case in which the processor of the tag extraction apparatus 103 may minimize an error due to interference between inserted signals when the additional service is provided based on the extracted tag information.

The control information may be information used for controlling the tag information. The control information may include the valid azimuth of the tag information to control the tag information. For example, when the tag information has a single valid azimuth, the control information may include the single valid azimuth of the tag information. When the tag information has N valid azimuths, the control information may include the N valid azimuths of the tag information.

Figure 7:
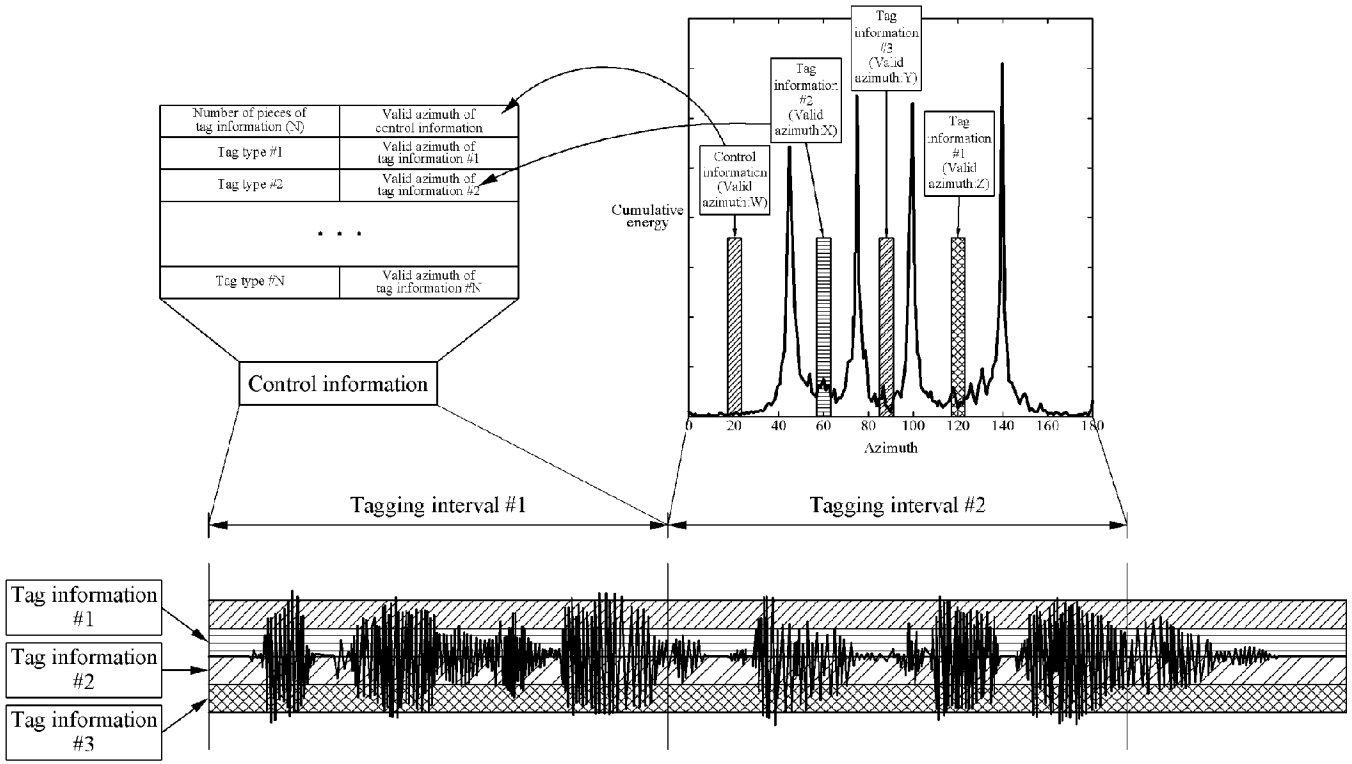
FIG. 7 is a diagram illustrating a stereo audio signal to which control information used for controlling tag information and a plurality of pieces of tag information according to an example embodiment.

FIG. 7 is a diagram illustrating a stereo audio signal to which control information used for controlling tag information and a plurality of pieces of tag information according to an example embodiment.

In FIG. 7, a current tagging interval may be a tagging interval #2 for extracting a plurality of pieces of tag information and control information that controls tag information. In this example, a tagging interval #1 may be a previous tagging interval.

A tag insertion apparatus may analyze an energy distribution of a tagging interval, determine valid azimuths of tag information and control information, and generated a multi-tagged stereo audio signal obtained by inserting the plurality of pieces of tag information and the control information into the original stereo audio signal.

The tag extraction apparatus may receive the multi-tagged stereo audio signal from a communication device. The tag extraction apparatus may acquire the control information from the previous tagging interval. Also, the tag extraction apparatus may extract desired tag information using the control information.

When playing contents, an additional service such as a content copyright identification service, a content copy control service, a content event search service, and a content distribution tracking service may be provided based on the tag information extracted by the tag extraction apparatus.

The tag insertion apparatus may analyze the energy distribution of the original stereo audio signal based on an azimuth in the tagging interval #2 corresponding to the current tagging interval. A valid azimuth may be determined such that an error due to an inter-signal interference is minimized when playing the contents. For example, to minimize the error due to the inter-signal interference, the tag insertion apparatus may determine a valid azimuth W for control information in the tagging interval #2 corresponding to the current tagging interval, a valid azimuth X for tag information #2, a valid azimuth Y for tag information #3, and a valid azimuth Z for tag information #4.

The control information of the tagging interval #2 corresponding to the current tagging interval may be obtained based on the tagging interval #1 corresponding to the previous tagging interval. Transmitted control information may include information associated with, for example, a valid azimuth of the control information, a valid azimuth of the plurality of pieces of tag information, the number of pieces of tag information, and a tag type corresponding to an identifier of the tag information. For example, the tag extraction apparatus may acquire the value azimuths X, Y, and Z based on the valid azimuth W of the control information. Also, the tag extraction apparatus may identify the tag types #1 through #3 based on the valid azimuth W of the control information.

The tag extraction apparatus may extract the plurality of pieces of tag information inserted into the tagging interval #2 corresponding to the current tagging interval based on the control information received from the tagging interval #1 corresponding to the previous tagging interval. The tag extraction apparatus may search for the valid azimuth of the plurality of pieces of tag information based on the control information extracted from the tagging interval #1 corresponding to the previous tagging interval to extract the tag information.

The tag extraction apparatus may extract desired tag information based on the valid azimuth of the found tag information. For example, the tag extraction apparatus may acquire the valid azimuth of the tag information #2 of the current tagging interval using the valid azimuth W of the control information extracted from the previous tagging interval. Through this, the tag extraction apparatus may extract the tag information #2.

The tag type that is an identifier of tag information may be retrieved based on a valid azimuth of the extracted tag information. When playing contents, a desired additional service such as a content copyright identification service, a content copy control service, a content event search service, and a content distribution tracking service may be executed based on the found tag type.

For example, the tag information #2 may correspond to an additional service associated with the content event search service. In this example, the tagging interval #2 may receive the control information from the tagging interval #1. The received control information may include the number of pieces of tag information, a valid azimuth W of the control information, a tag type #2 corresponding to an identifier of tag information, and a valid azimuth X of the tag information #2. The tag extraction apparatus may search for the tag type #2 in the current tagging interval based on the control information acquired from the previous tagging interval, thereby extracting the tag information #2.

In the present disclosure, the tag extraction apparatus may provide a content service such as a broadcasting service. In this example, the tag extraction apparatus may provide an additional service applicable to a content service while providing the content service. The tag extraction apparatus may search for the tag type #2 that is the identifier of the tag information #2 and play the tag type #2, thereby providing the additional service associated with the content event service with a content service.

In an example of FIG. 7, the tag information #1, the tag information #2, and the tag information #3 may be information used for copyright identification, copy control, and content event search services for preventing illegal distribution of contents. To provide various application services at a predetermined point in time, information used for the copyright identification and the copyright may be inserted during an overall tagging interval. Also, information used for the content event search service may be inserted when a related service is to be provided.

The components described in the exemplary embodiments of the present invention may be achieved by hardware components including at least one DSP (Digital Signal Processor), a processor, a controller, an ASIC (Application Specific Integrated Circuit), a programmable logic element such as an FPGA (Field Programmable Gate Array), other electronic devices, and combinations thereof. At least some of the functions or the processes described in the exemplary embodiments of the present invention may be achieved by software, and the software may be recorded on a recording medium. The components, the functions, and the processes described in the exemplary embodiments of the present invention may be achieved by a combination of hardware and software.

The processing device described herein may be implemented using hardware components, software components, and/or a combination thereof. For example, the processing device and the component described herein may be implemented using one or more general-purpose or special purpose computers, such as, for example, a processor, a controller and an arithmetic logic unit (ALU), a digital signal processor, a microcomputer, a field programmable gate array (FPGA), a programmable logic unit (PLU), a microprocessor, or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will be appreciated that a processing device may include multiple processing elements and/or multiple types of processing elements. For example, a processing device may include multiple processors or a processor and a controller. In addition, different processing configurations are possible, such as parallel processors.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A tag insertion method performed by an apparatus for inserting a tag into a stereo audio signal, the method comprising:

receiving an original stereo audio signal;

analyzing an energy distribution of the original stereo audio signal based on an azimuth;

determining valid azimuths for control information and for a plurality of pieces of tag information based on the energy distribution, wherein the control information is used to control tag information;

modulating the plurality of pieces of tag information and the control information generated based on the valid azimuths;

generating a left signal and a right signal based on the modulated control information and the plurality of pieces of modulated tag information; and generating a multi-tagged stereo audio signal by mixing the generated left signal and the generated right signal with the original stereo audio signal.

2. The tag insertion method of claim 1, wherein the valid azimuths determined with respect to the plurality of pieces of tag information are determined to be angles within an azimuth representing an amount of energy less than or equal to a preset threshold in the energy distribution.

3. The tag insertion method of claim 1, wherein the valid azimuth determined with respect to the control information is determined to be an angle within a first azimuth representing an amount of energy less than or equal to a preset threshold in the energy distribution.

4. The tag insertion method of claim 1, wherein the generating of the left signal and the right signal includes generating the left signal and the right signal using the valid azimuths and a signal intensity ratio between the left signal and the right signal.

5. The tag insertion method of claim 1, wherein the modulating of the control information and the plurality of pieces of tag information includes modulating the control information and the plurality of pieces of tag information based on a differential quadrature phase shift keying (DQPSK)-orthogonal frequency division multiplexing (OFDM) scheme or a $\pi/4$ DQPSK-OFDM scheme.

6. The tag insertion method of claim 1, wherein the analyzing of the energy distribution includes analyzing an energy distribution of an original stereo audio signal converted from a time domain to a frequency domain, based on an azimuth.

7. A tag extraction method performed by an apparatus for extracting a tag from a stereo audio signal, the method comprising:

receiving a multi-tagged stereo audio signal in which an original stereo audio signal is mixed with a left signal and a right signal;

separating control information and a plurality of pieces of tag information from the multi-tagged stereo audio signal using a valid azimuth included in the control information; and demodulating the control information and the plurality of pieces of tag information.

8. The tag extraction method of claim 7, wherein the separating of the control information and the plurality of pieces of tag information includes separating the control information and the plurality of pieces of tag information based on an azimuth discrimination and resynthesis (ADRess) algorithm based on a signal intensity ratio between the left signal and the right signal or a degenerate unmixing estimation technique (DUET) algorithm sound source separation scheme.

9. The tag extraction method of claim 7, wherein the demodulating includes demodulating control information used in a subsequent tagging interval.

10. The tag extraction method of claim 9, wherein the plurality of pieces of demodulated tag information is used to provide additional services simultaneously at a predetermined point in time, the additional services including a content copyright identification service, a content copy control service, a content distribution tracking service, and a content event search service.

11. An apparatus for inserting a tag into a stereo audio signal, the apparatus comprising:

a processor, wherein the processor is configured to:

receive an original stereo audio signal;

analyze an energy distribution of the original stereo audio signal based on an azimuth;

determine valid azimuths for control information and for a plurality of pieces of tag information based on the energy distribution, wherein the control information is used to control tag information;

modulate the plurality of pieces of tag information and the control information generated based on the valid azimuths;

generate a left signal and a right signal based on the modulated control information and the plurality of pieces of modulated tag information; and generate a multi-tagged stereo audio signal by mixing the generated left signal and the generated right signal with the original stereo audio signal.

12. The apparatus of claim 11, wherein the valid azimuths determined with respect to the plurality of pieces of tag information are determined to be angles within an azimuth representing an amount of energy less than or equal to a preset threshold in the energy distribution.

13. The apparatus of claim 11, wherein the valid azimuth determined with respect to the control information is determined to be an angle within a first azimuth representing an amount of energy less than or equal to a preset threshold in the energy distribution.

14. The apparatus of claim 11, wherein the processor is configured to generate the left signal and the right signal using the valid azimuths and a signal intensity ratio between the left signal and the right signal.

15. The apparatus of claim 11, wherein the processor is configured to modulate the control information and the plurality of pieces of tag information based on a differential quadrature phase shift keying (DQPSK)-orthogonal frequency division multiplexing (OFDM) scheme or a $\pi/4$ DQPSK-OFDM scheme.

16. The apparatus of claim 11, wherein the processor is configured to analyze an energy distribution of an original stereo audio signal converted from a time domain to a frequency domain, based on an azimuth.

* * * * *